US006053433A

United States Patent [19]

Py

[11] Patent Number: 6,053,433

[45] **Date of Patent: *Apr. 25, 2000**

[54] SYSTEM AND METHOD FOR ONE-WAY SPRAY/AEROSOL TIP

[76] Inventor: Daniel Py, 8 Normandy Rd., Larchmont, N.Y. 10538

[ * ] Notice: This patent is subject to a terminal disclaimer.

[21] Appl. No.: 09/192,843

[22] Filed: Nov. 16, 1998

Related U.S. Application Data

[63] Continuation of application No. 08/927,221, Sep. 10, 1997, Pat. No. 5,855,322.

[51] Int. Cl.[7] ..... B05B 1/30

[52] U.S. Cl. ..... 239/574; 239/333; 239/464; 239/533.13

[58] Field of Search ..... 239/11, 331, 333, 239/464, 469, 533.13, 570, 571, 574, DIG. 12; 222/321.2, 321.3, 380

[56] References Cited

U.S. PATENT DOCUMENTS

| | | |
|---|---|---|
| 4,313,569 | 2/1982 | Burke . |
| 4,623,337 | 11/1986 | Maurice . |
| 4,694,977 | 9/1987 | Graf et al. . |
| 4,944,430 | 7/1990 | Graf et al. . |
| 4,946,452 | 8/1990 | Py . |
| 4,981,479 | 1/1991 | Py . |
| 5,024,355 | 6/1991 | Jouillat et al. . |
| 5,133,702 | 7/1992 | Py . |
| 5,238,156 | 8/1993 | Andris . |
| 5,320,845 | 6/1994 | Py . |
| 5,358,179 | 10/1994 | Lund et al. . |
| 5,370,317 | 12/1994 | Weston . |
| 5,401,259 | 3/1995 | Py . |
| 5,613,957 | 3/1997 | Py . |

FOREIGN PATENT DOCUMENTS

| | | |
|---|---|---|
| 0 201 809 | 11/1986 | European Pat. Off. . |
| 0 492 354 | 7/1992 | European Pat. Off. . |
| WO93/10852 | 6/1993 | WIPO . |

*Primary Examiner*—Andres Kashnikow
*Assistant Examiner*—Steven J. Ganey
*Attorney, Agent, or Firm*—Kenyon & Kenyon

[57] ABSTRACT

A nozzle mechanism for generating an aerosol-type liquid discharge is provided, which nozzle mechanism ensures one-way movement of liquid during discharge and also has a substantially zero "dead volume" at the tip of the nozzle. The nozzle mechanism includes a flexible nozzle portion with an outlet and a fluid channel, a rigid shaft received within the flexible nozzle portion, and a rigid housing surrounding the flexible nozzle portion and exposing the outlet. The rigid shaft interfaces the outlet to form a first normally-closed, one-way valve, as well as to define a swirling chamber for collecting the liquid which has been channeled from the liquid reservoir, prior to being discharged via the outlet. The outlet has a tubular wall with thickness that decreases along the elongated axis of symmetry for the outlet toward the tip of the outlet. The fluid channel is circumferentially positioned within the flexible nozzle portion to create swirling action of the liquid delivered to said swirling chamber. Once the pressure on the swirling liquid reaches a threshold pressure sufficient to radially deform the portion of the outlet forming the first normally-closed valve, the liquid in the swirling chamber is discharged through the outlet. The nozzle mechanism is coupled to a flexible body portion which has a substantially tubular shape and a wall thickness which decreases from the bottom of the body portion toward the flexible nozzle portion. The rigid shaft received within the flexible nozzle portions extends down into the flexible body portion so that a second portion of the rigid shaft interfaces the flexible body portion to form a second normally-closed, one-way valve in the fluid communication path between the liquid reservoir and the swirling chamber.

2 Claims, 6 Drawing Sheets

SYSTEM AND METHOD FOR ONE-WAY SPRAY/AEROSOL TIP

This application is a continuation of prior application Ser. No. 08/927,221, filed Sep. 10, 1997, now U.S. Pat. No. 5,855,322.

FIELD OF THE INVENTION

This invention relates generally to a system and method for generating a spray and/or an aerosol-type discharge, and relates more particularly to a system and a method for generating a spray and/or an aerosol-type discharge by means of an aerosol-tip mechanism which ensures one-way movement of liquid through the aerosol-tip mechanism.

BACKGROUND OF THE INVENTION

In recent years, spray and/or aerosol-type dispensers have received attention for their use in dispensing liquids, particularly medicaments. One persistent problem in designing spray and/or aerosol dispensers for dispensing medicaments is preventing contamination of the medicament which can occur when the medicament that has been exposed to ambient air returns and/or remains in the aerosol outlet channel, e.g., within the aerosol nozzle. One solution to this problem is to simply add preservatives to the medicament being dispensed, thereby preventing bacterial growth. However, this solution has obvious disadvantages, e.g., added costs and toxicity of the preservatives. In order to prevent bacterial growth in medicament which does not contain preservatives while allowing dispensation of multiple doses of the medicament, the aerosol nozzle must prevent medicament that has been previously exposed to ambient air from being sucked back into the aerosol outlet channel.

Another problem in designing spray and/or aerosol dispenser for dispensing medicaments is minimizing the number of components which constitute the spray/aerosol dispenser. As the number of components increases, the difficulty and cost of mass production increases.

Accordingly, it is an object of the present invention to provide an outlet nozzle or tip mechanism for dispensing liquid from a pump-type dispenser in aerosol or spray form, which nozzle or tip mechanism is adapted for combination with the pump-type dispenser without the need for additional components for, or modification of, the pump-type dispenser for facilitating the combination.

It is another object of the present invention to provide an outlet nozzle for an aerosol dispenser, which nozzle ensures one-way movement of liquid through the nozzle.

It is yet another object of the present invention to provide a method of dispensing liquid through an outlet nozzle for an aerosol dispenser, which method ensures one-way movement of liquid through the nozzle.

It is yet another object of the present invention to provide an outlet nozzle for an aerosol dispenser, which nozzle has a substantially zero "dead volume" in which liquid that has been exposed to ambient air can remain, i.e., the liquid is completely released once it passes through the outlet nozzle, or the combined effect of the surface tensions of the liquid and the surrounding outlet nozzle forces any remaining liquid out of, and away from, the outlet portion It is yet another object of the present invention to provide a method of ensuring that no liquid which has been exposed to ambient air returns to the interior portion of the nozzle of an aerosol dispenser.

It is yet another object of the present invention to provide an aerosol dispenser with a one-way nozzle, which dispenser minimizes the number of parts for manufacturing.

It is yet another object of the present invention to provide an aerosol dispenser having a plurality of valve mechanisms in the fluid communication path between the liquid reservoir and the outlet nozzle to ensure minimization of contact between the content of the liquid reservoir and liquid which may have been previously exposed to ambient air.

It is another object of the present invention to provide an outlet nozzle for an aerosol dispenser, which nozzle is adapted to generate an aerosol-type discharge by means of elastic, radial deformation along the circumference of the nozzle which provides an integral spring, while substantially maintaining the physical profile in the direction of the longitudinal axis of the nozzle.

It is another object of the present invention to provide an aerosol-type dispenser which does not require propellants such as CFCs, the release of which is harmful to the ozone layer, or the release pressure of which propellant is temperature dependent, thereby creating variations in dispensed dosages.

It is another object of the present invention to provide a pump-and-nozzle system for generating an aerosol-type discharge via a swirling chamber by means of an integral spring effect achieved by elastic, radial deformation along the circumference of the nozzle, which aerosol-type discharge is achieved with a minimum of "head loss."

SUMMARY OF THE INVENTION

In accordance with the above objects, the present invention provides a nozzle mechanism for generating an aerosol-type liquid discharge, which nozzle mechanism ensures one-way movement of liquid and also has a substantially zero "dead volume" at the tip of the nozzle. The nozzle mechanism according to the present invention may be adapted for use with a variety of types of liquid-dispensing apparatuses, for example, medicament dispensers which channel liquid from a liquid reservoir through the nozzle mechanism by application of pressure via a pump mechanism.

In one embodiment of the nozzle mechanism according to the present invention, the nozzle mechanism includes a flexible nozzle portion with an outlet and a fluid channel, a rigid shaft received within the flexible nozzle portion, and a rigid housing surrounding the flexible nozzle portion and exposing the outlet. The rigid shaft interfaces the outlet to form a first normally-closed, circumferential valve as well as to define a collecting chamber, or a "swirling chamber," for temporarily collecting the liquid which has been channeled from the liquid reservoir, prior to being discharged via the outlet. The outlet has an elastic outer wall, the thickness of which decreases along the elongated axis of symmetry of the outlet from a bottom portion of the outlet toward the tip of the outlet, thereby facilitating one-way movement of liquid through, and out of, the outlet.

In the above-described embodiment, the fluid channel, which defines a portion of a fluid communication path between the liquid reservoir and the collecting chamber, is circumferentially positioned within the flexible nozzle portion. The circumferentially positioned fluid channel provides uniform pressure with a minimum of head loss. As a result, the liquid pressure is uniformly applied at the entry point of the swirling chamber once the pressure within the circumferentially positioned fluid channel reaches a threshold pressure sufficient to radially deform a second normally-closed, circumferential valve forming a portion of the fluid communication path between the liquid reservoir and the collecting chamber, which second normally-closed valve is described in further detail below.

The above-described embodiment of nozzle mechanism according to the present invention may be coupled to a flexible body portion which has a substantially tubular shape and a wall thickness which decreases from the bottom of the body portion toward the flexible nozzle portion, along the elongated axis of symmetry of the body portion. The rigid shaft received within the flexible nozzle portions extends down into the flexible body portion so that a second portion of the rigid shaft interfaces the flexible body portion to form the second normally-closed, circumferential valve in the fluid communication path between the liquid reservoir and the collecting chamber. As with the first normally-closed, circumferential valve, the second normally-closed, circumferential valve is opened when the pressure on the liquid in the fluid communication path reaches a threshold pressure sufficient to radially deform the portion of the flexible body portion forming the second normally-closed, circumferential valve.

One advantage of the nozzle mechanism according to the present invention is that the configuration of the outlet portion substantially eliminates the possibility that liquid in the nozzle mechanism will come in contact with ambient air and subsequently return and/or remain in the interior portion of the nozzle mechanism. The nozzle mechanism achieves this result by means of the first normally-closed valve, which facilitates one-way movement of liquid from the nozzle mechanism through the outlet portion during discharge. Due to the first normally-closed valve, the outlet portion has a substantially zero "dead volume", i.e., a space in which liquid that has been exposed to ambient air can remain.

In addition to the first normally-closed valve, the second normally-closed valve positioned along the fluid communication path between the liquid reservoir and the outlet adds further assurances that liquid in the liquid reservoir will not be contaminated by liquid that has been exposed to ambient air and subsequently reintroduced into the nozzle mechanism. Because the first and second normally-closed valves are positioned along the fluid communication path to open asynchronously during fluid communication leading to discharge through the outlet, failure of either one of the valves will not affect the integrity of the nozzle mechanism to prevent contamination of the liquid in the liquid reservoir.

Another advantage of the nozzle mechanism according to the present invention is that the nozzle mechanism experiences substantially no deformation along the direction of the discharge path through the outlet, i.e., the elongated axis of symmetry for the outlet. As a result, the physical profile of the fluid channel, which induces swirling action of the liquid in the collecting chamber of the nozzle mechanism, is maintained during liquid discharge.

Another advantage of the nozzle mechanism according to the present invention is that the number of parts which constitute the nozzle mechanism and, in turn, the dispensing system which includes a pump mechanism in combination with the nozzle mechanism, is significantly reduced in comparison to conventional nozzle mechanisms. The reduced number of parts reduces costs and manufacturing complexity.

DETAILED DESCRIPTION OF THE INVENTION

Figure 1:
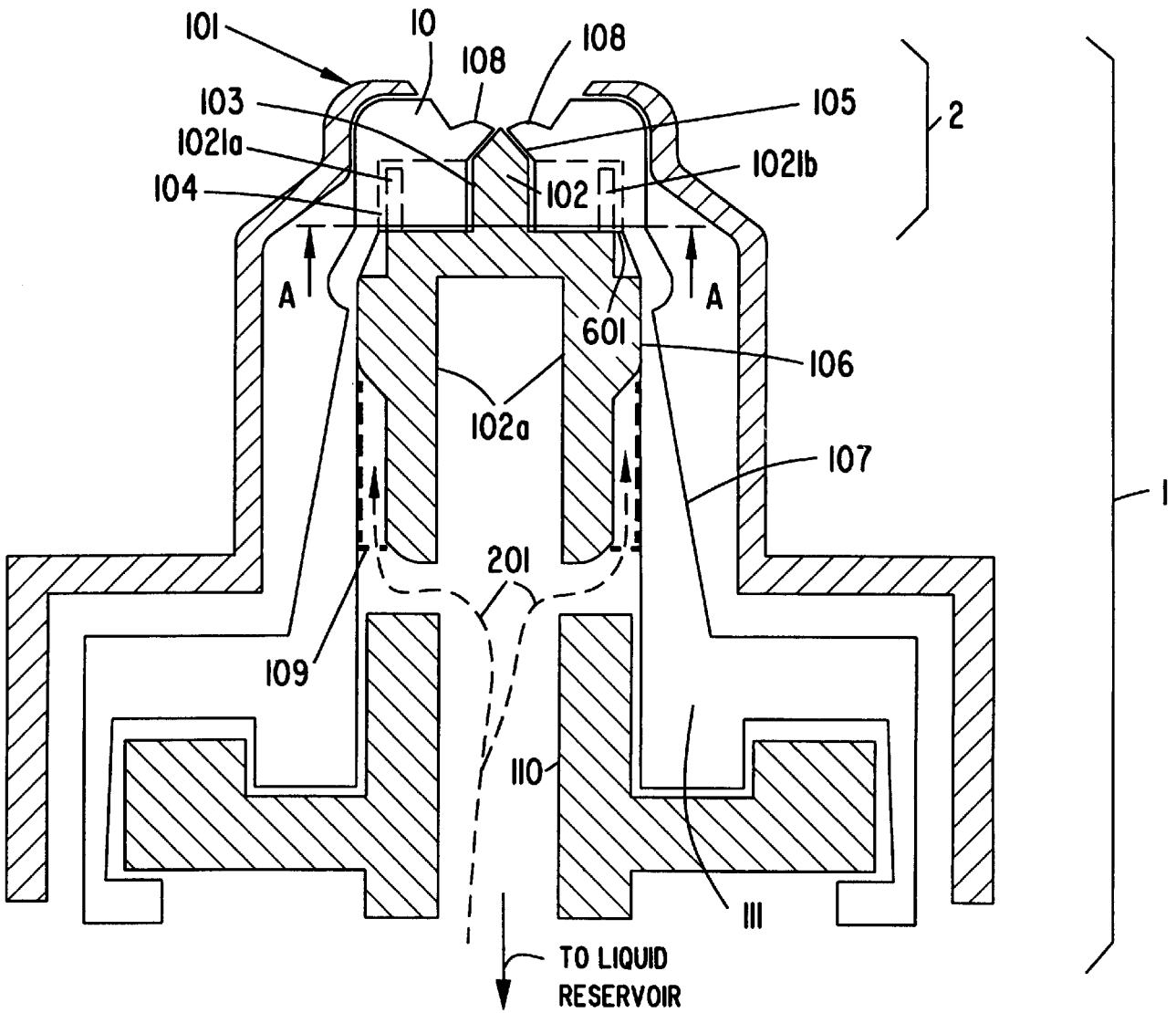
FIG. 1 is a cross-sectional view along the length of aerosol dispenser including one embodiment of a nozzle mechanism according to the present invention.
Figure 3:
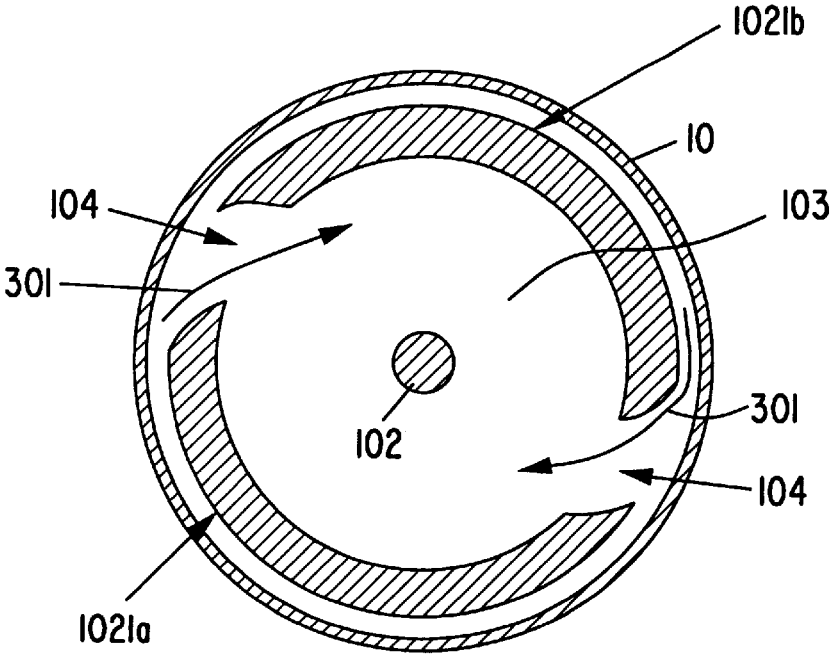
FIG. 3 is a cross-sectional view along line A—A shown in FIG. 1.

Referring generally to FIGS. 1 and 3, an aerosol-type dispenser system including a first exemplary embodiment of an aerosol tip or nozzle mechanism 2 according to the present invention is indicated generally at 1. The first exemplary embodiment of the aerosol tip mechanism 2 includes a flexible nozzle portion 10 having an outlet portion 108 and a fluid channel or swirling channel 104, a rigid shaft 102 received within the flexible nozzle portion 10, and a rigid external housing 101 surrounding the flexible nozzle portion 10 and exposing the outlet portion 108. The rigid shaft 102 interfaces the interior of the outlet portion 108 to form a first normally-closed valve 105, as well as to define a swirling chamber or collecting chamber 103 for liquid which has been channeled from a liquid reservoir, prior to being discharged via the outlet portion 108 of the aerosol tip mechanism 2.

As shown in FIGS. 1 and 3, for the first exemplary embodiment of the aerosol tip mechanism, the swirling channel or fluid channel 104 includes gaps between walls 1021*a* and 1021*b* circumferentially surrounding the rigid shaft 102. The swirling channel 104, which is described in further detail below, channels fluid into the swirling chamber 103.

Figure 6B:
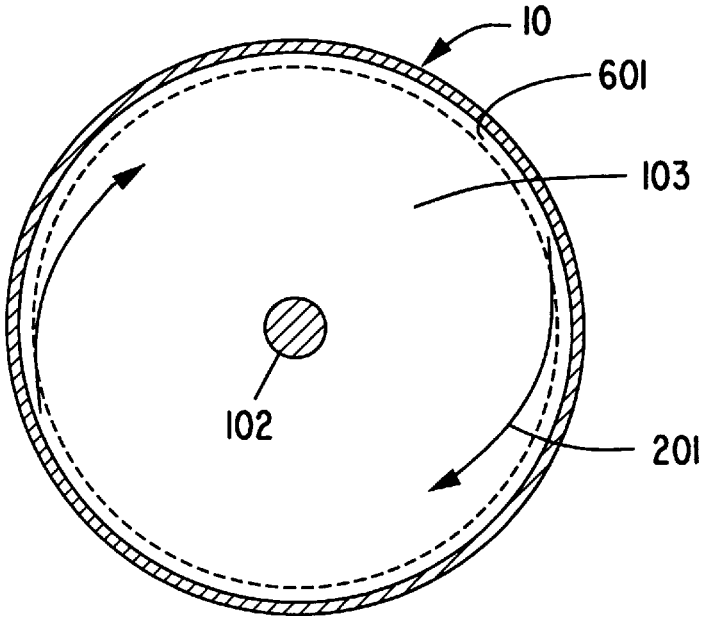
FIG. 6B is a cross-sectional view along line B—B shown in FIG. 6A.
Figure 6A:
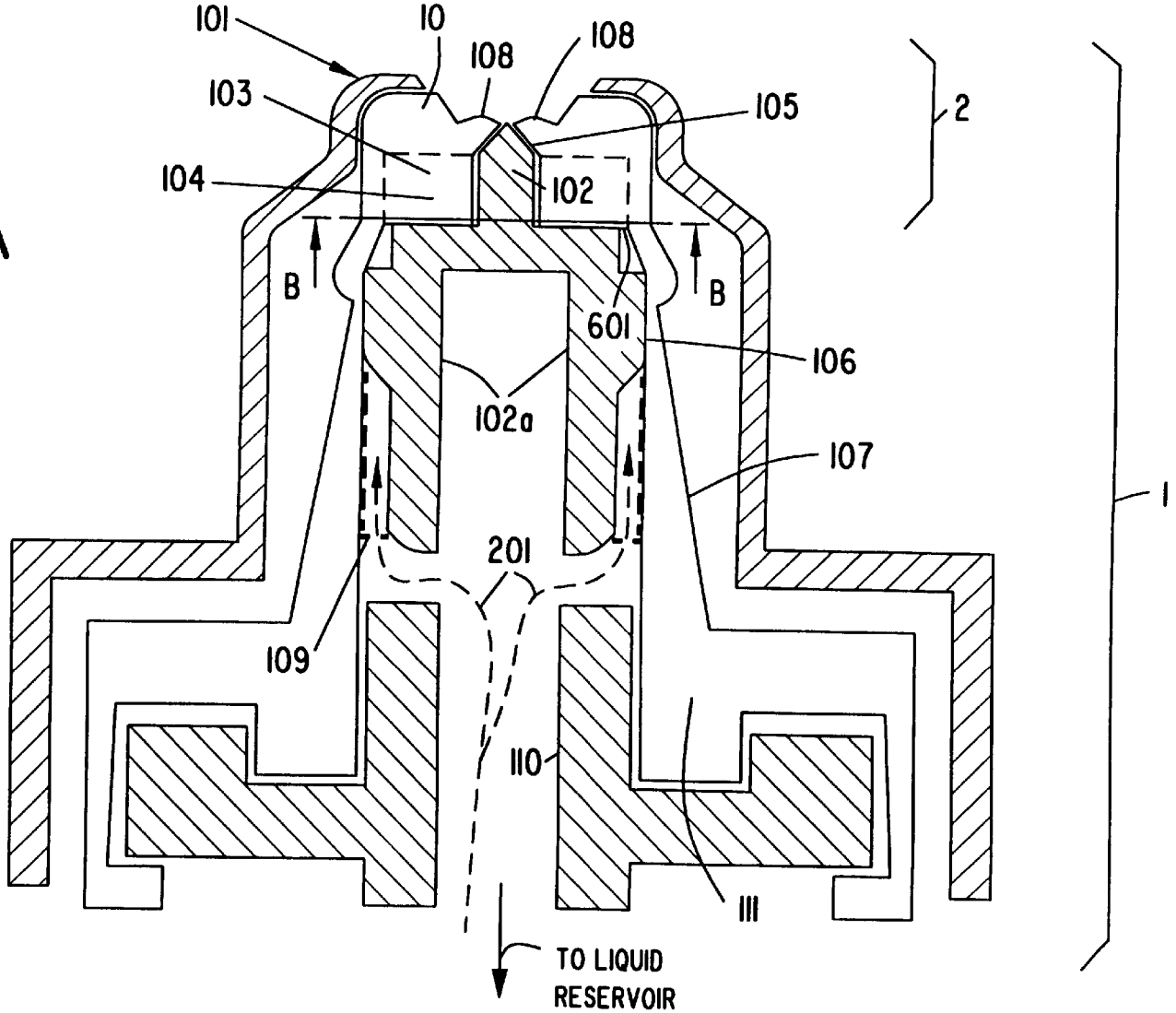
FIG. 6A is a cross-sectional view showing a second embodiment of the nozzle mechanism according to the present invention.

A second exemplary embodiment of the aerosol tip or nozzle mechanism 2 according to the present invention is shown in FIGS. 6A and 62. The second exemplary embodiment is substantially similar to the first exemplary embodiment, with one exception. In contrast to the first exemplary embodiment shown in FIGS. 1 and 3, the second exemplary embodiment of the aerosol tip or nozzle mechanism does not include walls 1021*a* and 1021*b* circumferentially surrounding the rigid shaft 102. Accordingly, in the second embodiment shown in FIGS. 6A and 6B, the swirling channel 104 is simply an integral part of the swirling chamber 103.

As shown in FIG. 1, the first exemplary embodiment of the aerosol tip or nozzle mechanism 2 according to the present invention is coupled to a flexible body portion 107 which has a substantially tubular shape and a wall thickness which decreases from the bottom of the body portion toward the flexible nozzle portion 10, along the elongated axis of symmetry of the body portion. The rigid shaft 102 received within the flexible nozzle portion 10 extends down into the flexible body portion 107 so that a second portion 102*a* of the rigid shaft interfaces the flexible body portion 107 to form a second normally-closed valve 106.

Figure 2:
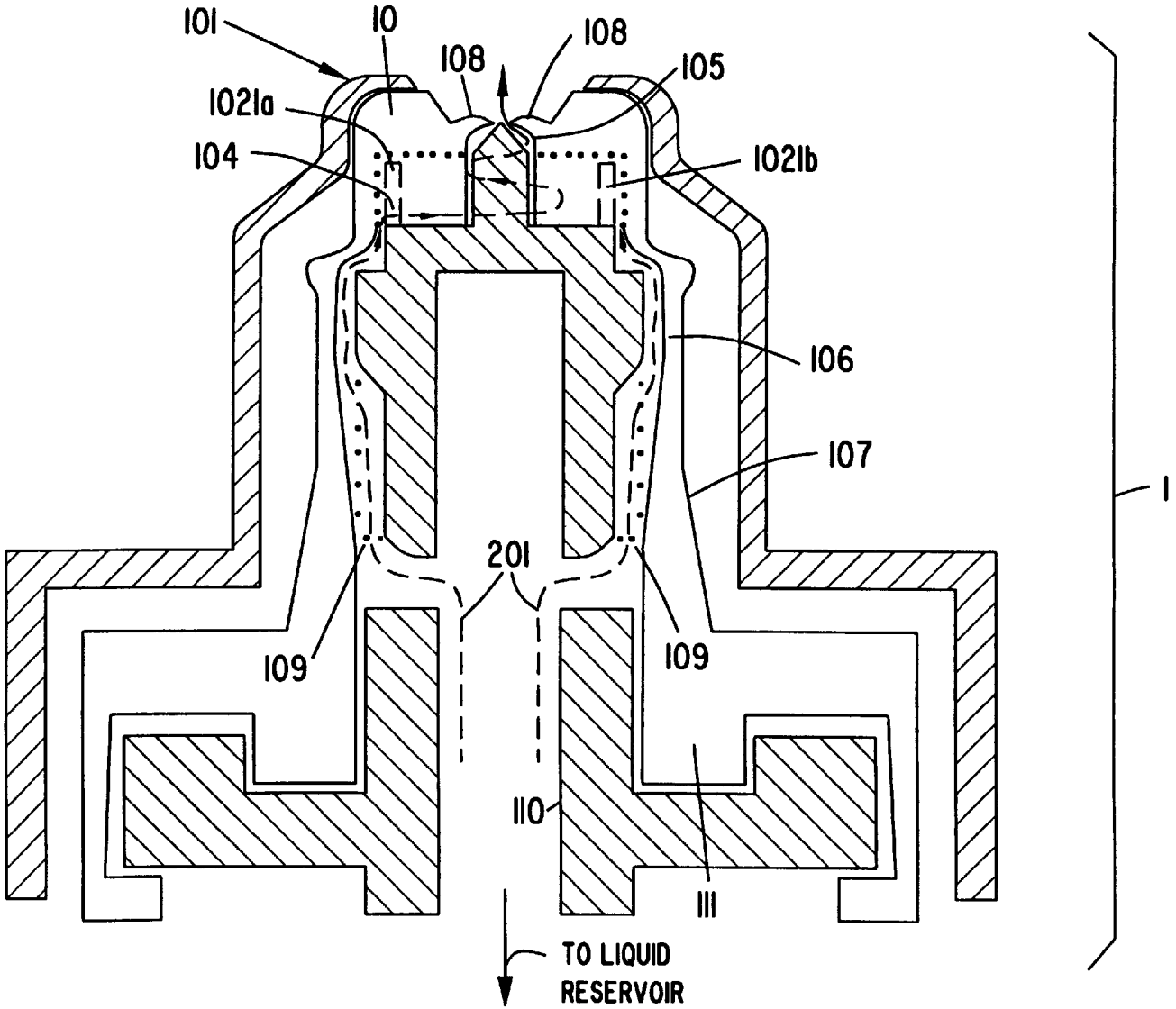
FIG. 2 is a cross-sectional view illustrating the flow path of liquid through the fluid communication path between the liquid reservoir and the nozzle mechanism of the aerosol dispenser shown in FIG. 1.

Referring generally to FIGS. 1 and 2, the fluid communication path 201 of liquid from the liquid reservoir to the outlet portion 108 successively traverses the first and second normally-closed valves 105 and 106, respectively. A pump mechanism 110 of the dispenser system 1, acting in concert with a pump-body portion 111 of the dispenser system, channels the liquid from the liquid reservoir along is the fluid communication path 201 by application of pressure. It should be noted that the nozzle mechanism according to the present invention is intended to be used in conjunction with a wide variety of liquid dispensing systems, one example of which is illustrated in applicant's commonly owned U.S. patent application Ser. No. 08/534,609 filed on Sep. 27, 1995, entitled "Fluid Pump Without Dead Volume," which is expressly incorporated herein by reference. Accordingly, it should be understood that the pump mechanism 110 and the pump-body portion 111 of the dispenser system shown in FIGS. 1 and 2 are merely exemplary and generic representation of a wide variety of dispensing systems.

Figure 5A:
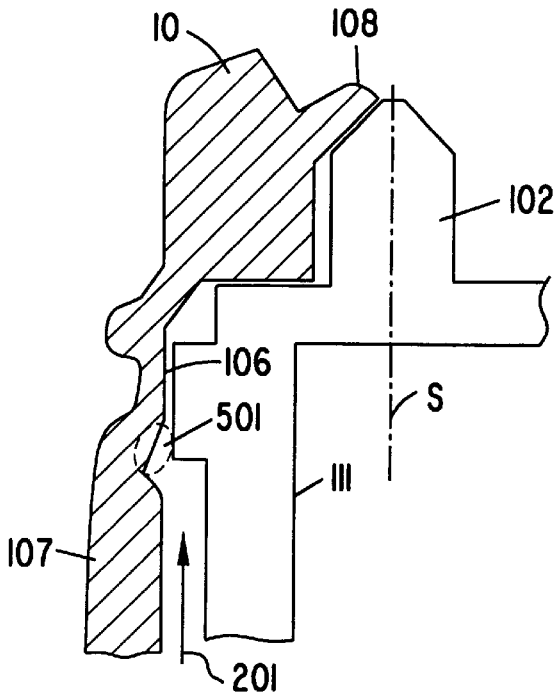
FIG. 5A is an enlarged cross-sectional view showing one stage of deformation of a valve in the body portion of the aerosol dispenser shown in FIG. 1.

As shown in FIGS. 1 and 2, the liquid from the liquid reservoir is initially channeled through a circumferential channel or groove 109 formed on the exterior of the second portion 102*a* of the rigid shaft. Once the pressure on the liquid in the fluid communication path reaches a threshold pressure sufficient to radially deform the flexible body portion 107, a portion 501 of the flexible body portion 107 forming a lower segment of the second normally-closed valve 106 is radially deformed by the liquid, thereby opening the second normally-closed valve 106, as shown in FIG. 5A. As the liquid passes through the second normally-closed valve 106 toward the flexible nozzle portion 10, sequential segments of the flexible body portion 107 forming the second normally-closed valve 106 are radially deformed, as shown in FIGS. 5A and 5B, until the liquid finally passes through the upper-most segment 502 of the flexible body portion 107 forming the second normally-closed valve 106.

Figure 5B:
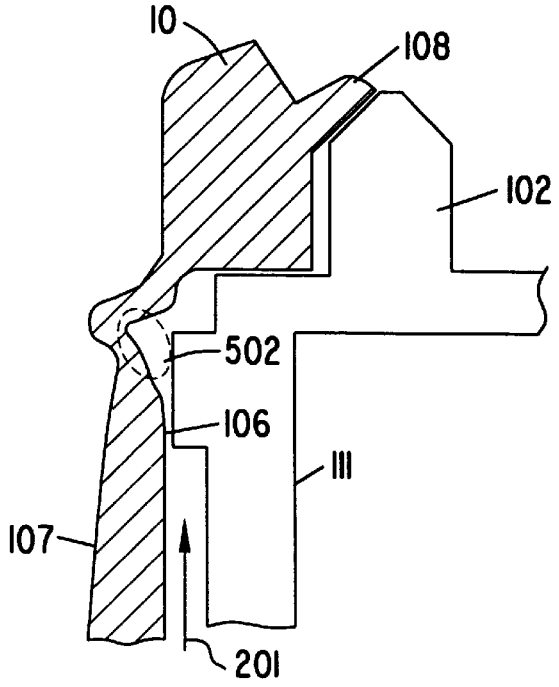
FIG. 5B is an enlarged cross-sectional view showing another stage of deformation of the valve in the body portion of the aerosol dispenser shown in FIG. 1.

As shown in FIGS. 5A and 5B, because the wall thickness of the flexible body portion 107 decreases from the lower segment 501 to the upper segment 502 of the second normally-closed valve 106, i.e., along the elongated axis of symmetry S of the nozzle mechanism, the lower segment 501 of the valve 106 is substantially closed by the time the liquid has reached the upper segment 502. Because the energy required to open the lower segment 501 of the valve 106 is greater than the energy required to open the upper segment 502, the liquid is naturally biased to maintain its forward movement through the second valve 106 in the flexible body portion 107 once the lower segment 501 has been opened. In this manner, the second normally-closed valve 106 ensures liquid movement only in the direction towards the flexible nozzle portion 10.

Once the liquid in the fluid communication path 201 has traversed the second normally-closed valve 10, the liquid then enters the fluid channel 104 within the flexible nozzle portion 10 of the first embodiment of the aerosol tip mechanism 2, as shown in FIGS. 1, 2 and 3. The fluid channel 104, which defines a portion of the fluid communication path 201 between the liquid reservoir and the collecting chamber 103, is circumferentially positioned within the flexible nozzle portion, as shown in FIG. 3. The circumferentially positioned fluid channel 104 creates swirling action of the liquid, indicated in FIG. 3 by the directional arrow 301, as it is channeled into the swirling chamber 103. For the second embodiment of the aerosol tip mechanism shown in FIGS. 6A and 6B, the liquid directly enters the swirling chamber 103 via the space 601 once the liquid in the fluid communication path 201 has traversed the second normally-closed valve 106. The swirling action of the liquid is maintained in the swirling chamber until the liquid is discharged via the outlet portion 108, the mechanics of which discharging action is described in detail below.

Figure 4A:
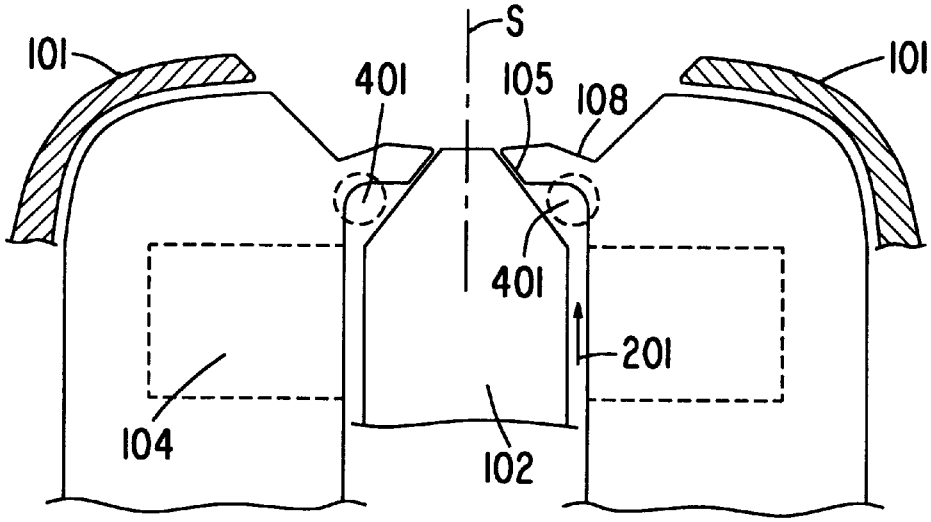
FIG. 4A is an enlarged cross-sectional view showing one stage of deformation of a valve in the nozzle mechanism according to the present invention shown in FIG. 1.
Figure 4B:
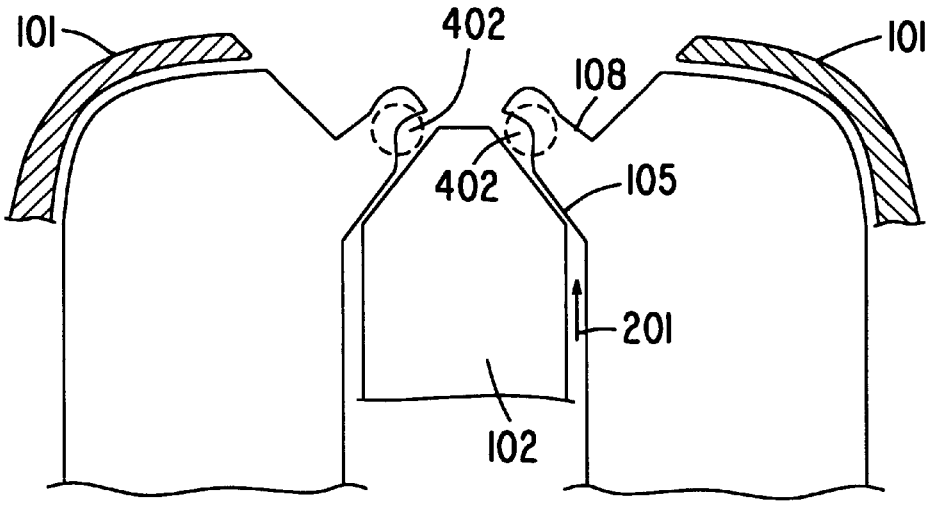
FIG. 4B is an enlarged cross-sectional view showing another stage of deformation of the valve in the nozzle mechanism according to the present invention shown in FIG. 1.

Referring generally to FIGS. 1, 4A and 4B, the liquid in the swirling chamber is discharged via the outlet portion 108 when the liquid pressure reaches a threshold pressure sufficient to radially deform the outlet portion 108 forming the first normally-closed valve 105. As with the second normally-closed valve 106 described above, the liquid movement through the first normally-closed valve 105 involves sequential deformation of segments of the outlet portion 108. As shown in FIG. 4A, a portion 401 of the outlet portion 108 forming a lower segment of the first normally-closed valve 105 is radially deformed by the liquid, thereby opening the first normally-closed valve 105. As the liquid passes through the first normally-closed valve 105 toward the tip of the outlet portion 108, sequential segments of the outlet portion 108 forming the first normally-closed valve 105 are radially deformed, as shown in FIGS. 4A and 4B, until the liquid finally passes through the upper-most segment 402 of the outlet portion 108 forming the first normally-closed valve 105.

As shown in FIGS. 1, 4A and 4B, the wall thickness of the outlet portion 108 decreases from the lower segment 401 towards the upper segment 402 of the first normally-closed valve 105, i.e., along the elongated axis of symmetry S of the aerosol tip or nozzle mechanism. Due to this steady decrease in wall thickness, the lower segment 401 of the valve 105 is substantially closed by the time the liquid has reached the upper segment 402, as shown in FIGS. 4A and 4B. Because the energy required to open the lower segment 401 of the valve 105 is greater than the energy required to open the upper segment 402, the liquid is naturally biased to maintain its forward movement through the first valve 105 in the outlet portion 108 once the lower segment 401 has been opened. Accordingly, the valve 105 ensures liquid movement only in the direction towards the exterior tip of the nozzle portion 10.

During the discharge of liquid through the outlet portion 108, the only segment of the flexible nozzle portion 10 which experiences deformation along the elongated axis of symmetry S of the aerosol tip or nozzle mechanism is the outlet portion 108. The remaining segments of the flexible nozzle portion are prevented by the rigid housing 101 from deformation along the elongated axis of symmetry S. Even the outlet portion 108 experiences only minimal deformation along the axis S; the significant deformation is along the radial direction. Furthermore, the outlet portion 108 does not exert a force along the axis S on the rigid shaft 102, i.e., the outlet portion 108 does not rub the rigid shaft during opening or closing of the first valve 105. Accordingly, because of the absence of any rubbing contact between the outlet portion 108 and the rigid shaft 102, the chances of contaminants entering the swirling chamber 103 are minimized.

One advantage of the aerosol tip or nozzle mechanism according to the present invention is the above-described prevention of axial deformation of the flexible nozzle portion 10 by the rigid housing 101. Because the flexible nozzle portion 10, with the exception of the outlet portion 108, experiences substantially no deformation along the elongated axis of symmetry S shown in FIG. 4A, the physical profile of the fluid channel 104, which induces swirling action of the liquid channeled into the swirling chamber 103, is maintained during liquid discharge. An axial deformation of the flexible nozzle portion 10 along the direction of liquid discharge would deform the fluid channel 104, which in turn would prevent the swirling action from occurring.

In the above-described embodiment of the aerosol tip or nozzle mechanism according to the present invention, the flexible nozzle portion 10, the flexible body portion 107 and the pump-body portion 111 may be made of any one of several materials well known in the art, including butadiene polyethylene styrene (KRATON™), polyethylene, polyurethane or other plastic materials, thermoplastic elastomers or other elastic materials. KRATON™ is particularly well suited for this purpose because of its characteristic resistance to permanent deformation, or "creep," which typically occurs with passage of time.

Another advantage of the aerosol tip or nozzle mechanism according to the present invention is that the number of parts which constitute the nozzle mechanism and, in turn, the dispensing system which includes a pump mechanism in combination with the nozzle mechanism, is significantly reduced in comparison to conventional nozzle mechanisms. AS can be seen from FIG. 1, an aerosol-type dispensing system incorporating the nozzle mechanism according to the present invention can be made using only three discrete parts: the rigid housing 101; an integral, flexible piece encompassing the flexible nozzle portion 10, the flexible body portion 107 and the pump-body portion 111; and the rigid shaft 102 formed integrally with the pump mechanism 110. Because only three discrete parts are required, the cost and complexity of manufacturing an aerosol-type dispensing system is significantly reduced.

Yet another advantage of the aerosol tip or nozzle mechanism according to the present invention is that the first normally-closed, one-way valve 105 with its decreasing wall thickness of the outlet portion 108 substantially eliminates the possibility that liquid in the nozzle mechanism will come in contact with ambient air and subsequently return to the interior portion of the nozzle mechanism. Due to the decreasing wall thickness of the outlet portion 108, the liquid is naturally biased to maintain its forward movement through the first valve 105 in the outlet portion 108 once the thicker base portion of the valve has been opened. Accordingly, the outlet portion 108 has a substantially zero "dead volume," i.e., a space in which liquid that has been previously exposed to ambient air can remain.

Still another advantage of the aerosol tip or nozzle mechanism according to the present invention is that the outlet portion 108 does not rub the rigid shaft 102 during opening or closing of the first valve 105. Accordingly, because of the absence of any rubbing contact between the outlet portion 108 and the rigid shaft 102, the chances of contaminants entering the swirling chamber 103 are minimized.

Still another advantage of the aerosol tip or nozzle mechanism according to the present invention is the presence of multiple valves along the fluid communication path leading to the outlet portion 108. In addition to the first normally-closed valve, the second normally-closed valve positioned along the fluid communication path between the liquid reservoir and the outlet adds further assurances that liquid in the liquid reservoir will not be contaminated by liquid that may have been accidentally exposed to ambient air and subsequently reintroduced into the nozzle mechanism. Because the first and second normally-closed valves are positioned along the fluid communication path to open sequentially, and hence asynchronously, during fluid communication leading to discharge through the outlet, failure of either one of the valves will not affect the integrity of the nozzle mechanism to prevent contamination of the liquid in the liquid reservoir.

While specific embodiments have been described above, it should be readily apparent to those of ordinary skill in the art that the above-described embodiments are exemplary in nature since certain changes may be made thereto without departing from the teachings of the invention, and the exemplary embodiments should not to be construed as limiting the scope of protection for the invention as set forth in the appended claims. For example, while the exemplary embodiment of the aerosol tip or nozzle mechanism according to the present invention has been described as having tubular-shaped outlet portion, other shapes, e.g., square or rectangle, may be used for the outlet portion.

What is claimed is:

1. A nozzle mechanism for an aerosol-type dispenser for dispensing liquid content by application of pressure, comprising:

a flexible nozzle portion having an outlet portion for dispensing said liquid content said outlet portion having a wall thickness which decreases from a first point along a direction of elongated axis of symmetry of said nozzle mechanism toward a tip of the flexible nozzle portion;

a first normally-closed valve within the outlet portion for controlling flow through said outlet portion; and a swirling chamber within said flexible nozzle portion for temporarily housing said liquid content prior to expulsion via said outlet portion;

wherein said liquid in said chamber is expelled via said first normally-closed valve upon reaching a threshold pressure sufficient to sequentially and radially open segments of said first normally-closed valve along said elongated axis of symmetry of said nozzle mechanism, whereby an initial segment of said valve opened is substantially closed when a final segment of said valve is open.

2. The nozzle mechanism according to claim 1 further comprising a rigid housing surrounding said flexible nozzle portion and exposing said outlet portion, wherein said rigid housing prevents deformation of said outlet portion along said elongated axis of symmetry during expulsion of said liquid content of said chamber via said outlet portion.

* * * * *

UNITED STATES PATENT AND TRADEMARK OFFICE

CERTIFICATE OF CORRECTION

PATENT NO. : 6,053,433

DATED : April 25, 2000

INVENTOR(S) :

PY, Daniel

It is certified that error appears in the above-identified patent and that said Letters Patent is hereby corrected as shown below:

Column 1, line 63, change "portion" to --portion.--.

Column 4, line 55, change "62" to --6B--.

Column 5, line 15, delete "is".

Column 5, line 61, change "10" to --106--.

Column 7, line 27, change "AS" to --As--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*